United States Patent [19]

Sietmann et al.

[11] 4,424,041

[45] Jan. 3, 1984

[54] TROLLING DRIVE MEANS FOR BOATS

[76] Inventors: Vernon H. Sietmann; Leonard J. Lukehart, both of Laurel, Iowa 50141; Dale E. Locker, Gilman, Iowa 50106

[21] Appl. No.: 296,326

[22] Filed: Aug. 26, 1981

[51] Int. Cl.[3] ..... B63H 5/13

[52] U.S. Cl. ..... 440/5; 440/63

[58] Field of Search ..... 440/3–7, 440/49, 53, 55, 56, 58, 59, 60, 61, 62, 63, 66, 75, 86, 88; 74/664, 665 R, 665 F, 665 G, 665 T; 192/84 A; 114/150, 151

[56] References Cited

U.S. PATENT DOCUMENTS

| | | | |
|---|---|---|---|
| 2,714,866 | 8/1955 | Pleuger et al. | 440/6 |
| 3,139,853 | 7/1964 | McCarthy et al. | 440/66 |
| 3,468,126 | 9/1969 | Mercier | 114/150 |
| 3,596,625 | 8/1971 | Guenther | 440/6 |
| 3,709,186 | 1/1973 | Gotmalm | 440/5 |
| 3,881,443 | 5/1975 | Hamp | 440/6 |
| 3,983,834 | 10/1976 | Hirmann | 440/58 |
| 4,200,055 | 4/1980 | Siegel | 440/5 |
| 4,209,986 | 7/1980 | Cunningham | 114/150 |

*Primary Examiner*—Trygve M. Blix
*Assistant Examiner*—Jesús D. Sotelo
*Attorney, Agent, or Firm*—Zarley, McKee, Thomte, Voorhees & Sease

[57] ABSTRACT

A boat is disclosed having a conventional inboard motor operatively connected to a primary propeller on the exterior of the boat. A hydraulic motor is operatively connected to the boat in the proximity of the primary propeller. A hydraulic circuit including a hydraulic pump is operated by the inboard motor and is connected to the hydraulic motor for actuating the hydraulic motor. An electrically operated solenoid valve is imposed in the hydraulic circuit to selectively by-pass hydraulic fluid in the hydraulic circuit away from the hydraulic motor. The hydraulic motor is pivotally connected to the boat so that when in a first position, it will drive the boat forwardly, and when in a second position, it will drive the boat rearwardly. Conventional controls are provided to withdraw power from the primary propeller when the hydraulic motor is in operation.

2 Claims, 6 Drawing Figures

TROLLING DRIVE MEANS FOR BOATS

BACKGROUND OF THE INVENTION

In conventional fishing boats, trolling auxiliary motors are often provided for fishing purposes in addition to the primary drive mechanism of the boat. The primary drive mechanism normally causes the boat to move too fast for ideal trolling conditions even when slowed to a minimum speed. Consequently, the primary drive rotor is used to take the boat to the fishing location. It is then rendered inoperative, and the trolling motor is then actuated to propel the boat at the desired trolling speed for ideal fishing purposes.

Efforts have been made to utilize the inboard motor of a boat to operate both the primary and auxiliary drive mechanisms. However, these efforts have resulted in complex mechanical-electrical arrangements which are expensive to manufacture and maintain, and which involve complex operating parts. Typical of such prior art devices is the invention disclosed in U.S. Pat. No. 4,200,055 issued Apr. 29, 1980.

BRIEF SUMMARY OF THE INVENTION

Disclosed herein is a conventional boat having an inboard motor operatively connected to a primary propeller on the exterior of the boat. A hydraulic motor with a secondary propeller is pivotally secured to the boat in the proximity of the primary propeller and is adapted to be selectively pivoted from a first position to a second position. When in the first position, the operation of the hydraulic motor will drive the boat forwardly, and when in a second position the boat will move rearwardly. The hydraulic motor is utilized for trolling purposes when the primary propeller is in a dormant condition.

A hydraulic circuit includes a hydraulic pump operated by the inboard motor and is connected to the hydraulic motor. An electrically operated solenoid valve, normally closed, is imposed in the hydraulic circuit to selectively bypass hydraulic fluid in the hydraulic circuit away from the hydraulic motor.

It is an object of this invention to provide an auxiliary trolling motor for a fishing boat that is operated by the primary power source of the boat.

A further object of the invention is to provide a simple control for the auxiliary motor which is trouble free and which is inexpensive to manufacture and maintain.

A further object of the invention is to provide a hydraulic auxiliary trolling motor which will have its seals protected from increased hydraulic pressure when the boat is operating at high speeds through the primary drive propeller.

It is a further object of this invention to provide a hydraulic auxiliary trolling motor for fishing boats wherein some hydraulic pressure will always be exerted on the hydraulic motor to prevent the likelihood that water will penetrate the hydraulic motor.

A further object of this invention is to provide an auxiliary hydraulic trolling motor for fishing boats that will normally be submerged in the water for cooling purposes.

These and other objects will be apparent to those skilled in the art.

DESCRIPTION OF THE PREFERRED EMBODIMENT

Figure 1:
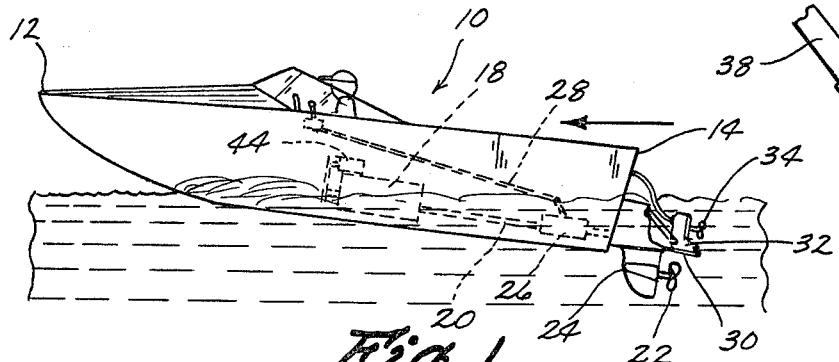
FIG. 1 is a side elevational view of the boat of this invention.

The numeral 10 generally designates a conventional boat having a forward end 12 and a rearward end 14. The boat 10 has a conventional control center 16.

A conventional inboard motor 18 has a power shaft 20 which extends therethrough and which is operatively connected to the outboard primary propeller 22 through propeller housing 24. A conventional transmission 26 is imposed in shaft 20 and is connected to the control center 16 through conventional control linkage 28. This conventional linkage permits the transmission to impose on primary propeller 22 conditions of forward or rearward motion, and static conditions of no motion at all (i.e., neutral position).

A pair of arms 30 are rigidly secured to propeller housing 24 and extend rearwardly therefrom. The rearward ends of arms 30 terminate in a pivotal connection with respect to the L-shaped housing of hydraulic motor 32. A secondary propeller 34 is connected to the power output of hydraulic motor 32.

Figure 4:
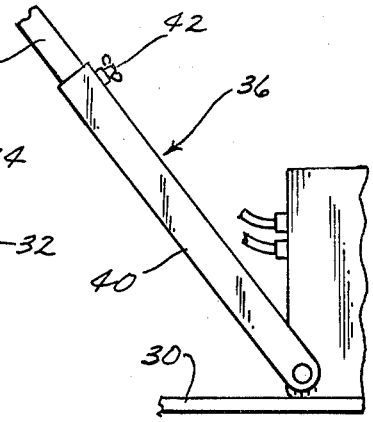
FIG. 4 is a partial elevational view of the auxiliary hydraulic motor mounting arrangement.
Figure 2:
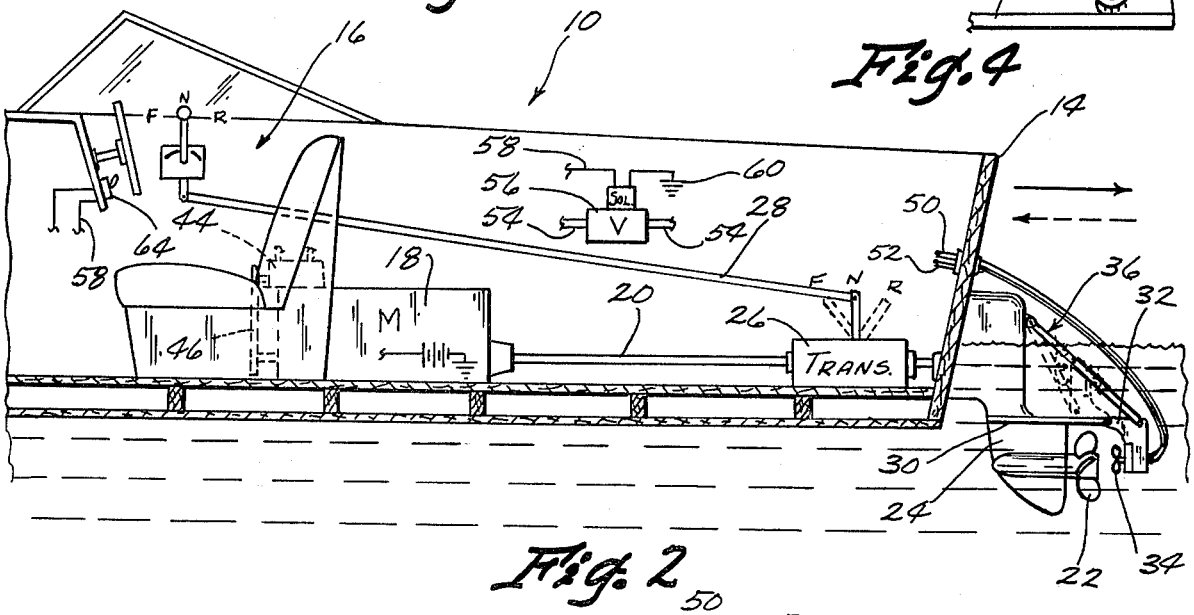
FIG. 2 is a partial sectional view of the boat of this invention as shown at an enlarged scale.

A telescopic arm 36 is comprised of telescopic arm members 38 and 40 which can be adjustably interconnected by wing nut mechanism 42. The upper end of arm member 38 is pivotally secured to the propeller housing 24, and the lower end of arm member 40 is pivotally secured to the L-shaped housing of hydraulic motor 32 as best shown in FIG. 4. By selectively adjusting the length of telescopic arm 36 through the wing nut mechanism 42, the hydraulic motor 32 can be changed from the forward drive position of FIG. 5 to the rearward drive position of FIG. 6. The forward and rearward drive positions being at different elevations in the same vertical plane.

Figure 3:
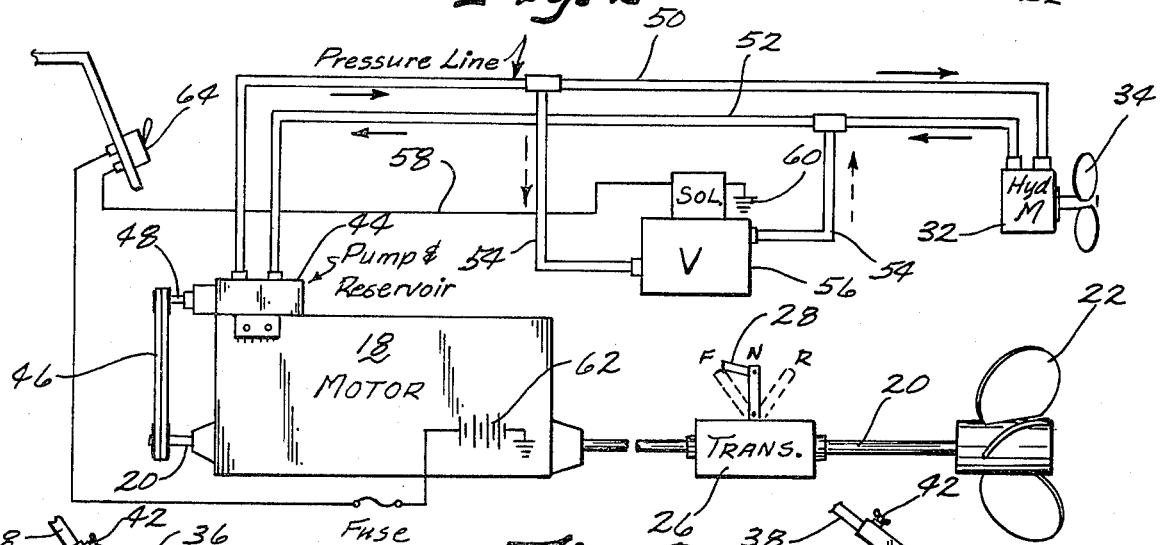
FIG. 3 is a schematic diagram showing the power train and hydraulic circuitry of this invention.

A hydraulic pump and reservoir 44 are mounted on motor 18 as shown in FIG. 3. A belt 46 interconnects the forward end of shaft 20 with shaft 48 which extends from the hydraulic pump and reservoir 44. A pressure line 50 extends from the pump to the hydraulic motor 32. Similarly, a return line 52 also interconnects the hydraulic motor 32 with the return port on the pump. A bypass line 54 interconnects the lines 50 and 52 as best shown in FIG. 3.

A normally closed solenoid valve 56 is imposed in hydraulic line 54. An electrical line 58 extends from ground 60 through the solenoid terminals of valve 56, and thence to the battery 62. A switch 64 at the control center 16 is imposed in line 58.

When the motor 18 is started, the pump 44 imposes hydraulic fluid under pressure to the hydraulic motor 32 which causes the secondary propeller 34 to rotate. The return line 52 carries the hydraulic fluid back to the hydraulic pump 44. The solenoid valve 56 is normally closed so that the bypass line 54 does not interfere with the operation of the hydraulic motor 32.

Normally, as the boat is being moved across a lake or the like to the desired fishing area, the switch 64 is closed to energize the solenoid of valve 56 to cause the valve to open. This causes the pressurized hydraulic fluid in line 50 to enter bypass line 54 rather than to go to the hydraulic motor 32. The fluid then goes through valve 56 and thence through the return line 52 whereby the hydraulic motor 32 is essentially bypassed. However, some hydraulic pressure is maintained within the hydraulic motor 32 which serves to prevent water from entering the hydraulic motor as might be the case if a negative pressure were imposed on the fluid in the motor. Also, in the event that the free wheeling of the secondary propeller 34 would create any increased pressure within the hydraulic motor while the boat was traveling at high speeds, the pressure would not build up for it would be exhausted in the flow of hydraulic fluid through the bypass line 54. Accordingly, the hydraulic motor is always effectively protected from both the invasion of fluid or the build up of pressure therein while it is not being used. The danger of increased pressure building up within the hydraulic motor is that the seals thereof might be destroyed.

When the boat arrives at the desired fishing site, the transmission 26 is moved by linkage 28 to a neutral position. The switch 64 is moved to an open position which causes the solenoid valve 56 to move to its closed position. This provides pressurized hydraulic fluid to the hydraulic motor 32 as described heretofore. The conventional throttle (not shown) on the motor 18 can be selectively adjusted to control the ultimate speed of the hydraulic motor 32.

Figure 5:
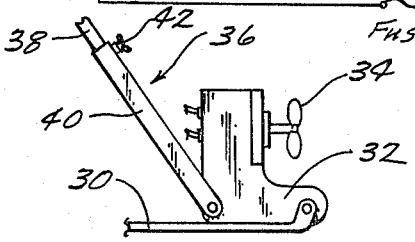
FIG. 5 is a view similar to that of FIG. 4 but at a smaller scale showing the position of the auxiliary hydraulic motor in a forward drive position.
Figure 6:
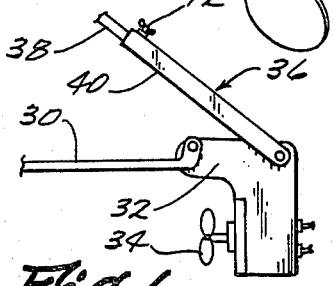
FIG. 6 is a view similar to that of FIG. 5 but the hydraulic motor is shown in a reverse position showing the position of the hydraulic motor when the boat is being pulled in a rearward direction.

The hydraulic motor 32 can propel the boat in either a forward or rearwardly direction by adjusting the position of the motor 32 as previously described (see FIGS. 5 and 6).

In view of the foregoing, it is seen that this invention will achieve at least all of its stated objectives.

We claim:

1. In combination with a boat having an inboard motor operatively connected to a primary propeller on the exterior of the boat, a hydraulic motor operatively connected to a secondary propeller and being supported by said boat in the proximity of said primary propeller, said primary and secondary propellers being vertically aligned, said hydraulic motor being vertically pivotally mounted with respect to said boat from a first position to a second position whereby actuation of said hydraulic motor in said first position will move said boat forwardly, and actuation of said hydraulic motor in said second position will move said boat rearwardly said first and second positions being at different elevations in the same vertical plane.

2. In combination with a boat having an inboard motor operatively connected to a primary propeller on the exterior of the boat and having a transmission imposed between said inboard motor and said primary propeller to withdraw power from said primary propeller at times, a hydraulic motor operatively connected to a secondary propeller and being pivotally supported by said boat in the proximity of said primary propeller, a hydraulic circuit including a hydraulic pump operated by said inboard motor and connected to said hydraulic motor for actuating said hydraulic motor, an electrically operated solenoid valve having only a first closed position and a second open position imposed on said hydraulic circuit to selectively bypass hydraulic fluid in said hydraulic circuit away from said hydraulic motor, and switch means electrically connected to said solenoid valve to selectively control the same, said solenoid valve normally being in said first closed position to permit fluid flow to said hydraulic motor when said inboard motor is operating and being selectively put into said second open position to permit fluid flow to bypass said hydraulic motor, said hydraulic circuit comprising pressure and return lines extending between said hydraulic pump and said hydraulic motor, and a bypass line connecting said pressure and return lines, with said solenoid valve being imposed in said bypass line, and said hydraulic circuit having sufficient fluid therein when said solenoid valve is in said second open position so as to prevent negative pressure on said fluid in said hydraulic motor, and increased fluid pressure in said hydraulic motor being prevented by bypassing said fluid in said hydraulic circuit away from said hydraulic motor, and said hydraulic motor being pivotally mounted with respect to said boat from a first position to a second position, said first position and said second position being at different elevations in the same vertical plane, whereby actuation of said hydraulic motor in said first position will move said boat forwardly and activation of said hydraulic motor in said second position will move said boat rearwardly.

* * * * *